United States Patent [19]

Luszczak

[11] Patent Number: 4,941,949

[45] Date of Patent: Jul. 17, 1990

[54] APPARATUS FOR MANUFACTURING TEXTURED ACOUSTICAL TILE

[75] Inventor: Myron M. Luszczak, Palatine, Ill.

[73] Assignee: USG Interiors, Inc., Chicago, Ill.

[21] Appl. No.: 319,937

[22] Filed: Mar. 6, 1989

Related U.S. Application Data

[62] Division of Ser. No. 861, Jan. 6, 1987, abandoned.

[51] Int. Cl.[5] ..... D21F 9/04

[52] U.S. Cl. ..... 162/310; 162/314; 162/210; 162/223; 425/326.1; 425/83.1; 425/387.1; 425/385; 264/119; 264/504

[58] Field of Search ..... 162/310, 314, 145, 208, 162/210, 223; 264/118, 119, 500, 504, 509, 517, 518, 544, 546, 555, DIG. 31, DIG. 32, DIG. 66, DIG. 68, DIG. 82, 48, 293; 425/385, 387.1, 373, 80.1, 326.1, 83.1, DIG. 241

[56] References Cited

U.S. PATENT DOCUMENTS

| | | | |
|---|---|---|---|
| 995,602 | 6/1911 | Howes | 162/115 |
| 1,641,047 | 8/1930 | Poston | 162/115 |
| 1,769,519 | 7/1930 | King et al. | 162/115 |
| 1,921,649 | 8/1933 | Becker | 92/40 |
| 1,996,033 | 3/1935 | King | 106/36 |
| 2,302,020 | 11/1942 | Frederick | 92/39 |
| 2,375,276 | 5/1945 | Brown | 264/DIG. 32 |
| 2,776,451 | 1/1957 | Chavannes | 264/555 |
| 3,042,577 | 7/1962 | Thomas | 162/115 |
| 3,246,063 | 4/1966 | Podgurski | 264/112 |
| 3,635,614 | 1/1972 | Long et al. | 425/385 |
| 3,635,625 | 1/1972 | Voss | 425/135 |
| 3,923,594 | 12/1975 | Lord | 162/208 |
| 4,140,458 | 2/1979 | Evert | 425/387.1 |
| 4,304,541 | 12/1981 | Cruse et al. | 426/296 |
| 4,317,792 | 3/1982 | Raley et al. | 264/504 |
| 4,342,719 | 8/1982 | Cruse et al. | 264/504 |
| 4,469,656 | 9/1984 | Ishii | 264/119 |
| 4,474,720 | 10/1984 | Izard | 264/156 |
| 4,496,515 | 1/1985 | Ptasienski et al. | 264/504 |

FOREIGN PATENT DOCUMENTS

| | | | |
|---|---|---|---|
| 0138601 | 4/1985 | European Pat. Off. | 264/504 |
| 1441758 | 4/1965 | France | 162/208 |
| 667 | of 1879 | United Kingdom | 162/208 |
| 149416 | 8/1920 | United Kingdom | 162/208 |

*Primary Examiner*—James C. Housel
*Assistant Examiner*—Jeremiah F. Durkin, II
*Attorney, Agent, or Firm*—Robert H. Robinson; John M. Lorenzen; Robert M. Didrick

[57] ABSTRACT

An apparatus for texturing the surface of wet cast plastic acoustical composition during manufacture of acoustical tiles by use of spinning air rolls. In the apparatus, at least one hollow cylindrical roll that is perforated in a random manner is suspended over the surface of wet cast plastic acoustical composition, the roll being driven by a motor. The interior of the roll is preferably provided with a perforated air tube or pipeline, from which issues uniform air pressurization of the spinning roll vessel. By providing differential speed of the roll in contrast to the line speed of the wet plastic composition and different air pressurization of the roll, a wide variety of textures may be produced on the surface of the wet plastic acoustical composition.

1 Claim, 2 Drawing Sheets

APPARATUS FOR MANUFACTURING TEXTURED ACOUSTICAL TILE

This is a divisional of co-pending application Ser. No. 000,861 filed on Jan. 6, 1987, now abandoned.

BACKGROUND OF THE INVENTION

1. Field of the Invention

This invention relates to a method of making acoustical tile normally utilized in ceiling constructions. More particularly, this invention relates to a method and apparatus for creating a textured surface on the wet tile during its manufacture. It relates still more particularly to the texturing of acoustical tile in a wet state as an aqueous plastic acoustical composition of mineral fiber material.

2. Description of the Prior Art

A popular type of acoustical tile is made following generally the procedure set forth in U.S. Pat. Nos. 1,769,519; 1,996,033; and 3,246,063. Generally, according to the of these patents, a mixture of mineral wool (preferably granulated), fillers, certain coloring materials if desired, and a binder, preferably of an amylaceous nature such as thick boiling starch, is used to form the body of the tile. Various other materials may be added to give certain properties to the tile. Generally, in manufacture the composition is placed upon suitable trays, which have previously been covered with a backing sheet such as paper; textured or surface smoothed to provide a pleasing surface such as that resembling travertine stone; placed in an oven; and then dried or cured at a temperature of about 250°–300° F. for from about 12 to about 18 hours. The dried sheets, called slabs, are removed from the tray or other mold; dressed on both faces and sides to provide smooth surfaces and obtain desired thickness and edge treatments; finish painted and the like, and cut into tiles of a desired size.

It is often desirable to impart a pleasing texture to such product for aesthetic reasons, and, to some extent, for improved acoustical properties. Methods known for imparting a texture include a patterned sand blasting of the dried and cured tile, rough screeding of the wet aqueous plastic composition, and pressing of the wet slab under a solid press roll having the reverse of the desired pattern in the roll. The sand blasting procedure must be very carefully controlled, and it is wasteful of the eroded material. The solid press rolls do not achieve high fidelity in the reproduction of the pattern and are very limited in the number of patterns available without extensive capitalization and inventory of rolls. The screeding procedure is limited as to the number of distinctive patterns that can be formed.

The screeding procedure, in more detail, involves screeding of the wet aqueous plastic composition mass with an oscillating bar. This produces a fine, lightly striated appearance depending upon the speed of the trays on the assembly line passing beneath it, the pressure of the bar and the nodule size of the granulated wool. It is at times desirable to produce a tile having a rougher, more stone-like appearance. This may be done by screeding with the edge of the screed. Instead of passing smoothly over the mass, the edge of the screed drags up some of the wool, resulting in rather large fissures or valleys in the surface and extending into the tile interior. This is more readily accomplished using larger or looser nodules of the granulated wool. It will be appreciated that the screeding process provides a more random, nonrepeating texturing of the surface than the other methods. However, it is quite limited in the number of patterns and variation in depth bas-relief.

Thus it is an object and advantage of the present invention to provide means for imparting a textured surface on cast acoustical composition which has the natural appearance and randomness of the screeding procedure yet providing infinitely variable number of three-dimensional texture patterns.

It is another object of this invention to provide an apparatus for producing acoustical composition having a textured surface which is not wasteful of the eroded material and which does achieve a high fidelity in the reproduction of natural appearing patterns having portions thereof being raised and portions thereof being in relief.

It is a further object and advantage of the present invention to provide a method and an apparatus for texturing ceiling tile in a moving wet pulp ceiling tile board manufacturing line in which surface patterns are produced that may vary from a very light, shallow, striated texture on the one hand to on the other hand, a very coarse, bold and deep texture resembling the naturally-looking fissures with undercuts of natural stone or rock.

Various other objects and advantages will readily occur to those skilled in the art to which this invention pertains from the following descriptions.

In carrying out this invention in one basic form, at least one hollow roll cylinder having a plurality of holes randomly placed over the surface therein is positioned above a moving wet pulp ceiling tile board line; and the roll cylinder is equipped with an air pressure line, whereby pressurized air moving through the holes in the roll impinges upon the surface of the wet pulp and produces a texture on the pulp surface. By varying the line speed of the ceiling tile board line, or the speed of the spinning roll, or both, different texture patterns varying from a linear striated series of furrows to a coarse, pitted, naturally-appearing fissure of natural rock is produced. Differing degrees of texture from a light, shallow, frost to very coarse, bold and deep textures may be produced by varying the air pressure within the roll, or the distance from the roll to the pulp, or both.

BRIEF DESCRIPTION OF THE DRAWINGS

FIGS. 3 and 4 illustrate the face surfaces of novel acoustical tiles 10 including, as more particularly shown in FIG. 1, a baked mineral fiber composition body 12 and a backing layer 14, such as of paper or aluminum foil firmly bonded to the back surface of the body; and the surface portion thereof having grooves furrows or fissures 15 depicting respectively a fine shallow pattern produced by the process of the invention in FIG. 3 or a deep, bold, highly textured pattern produced by the invention in FIG. 4.

Figure 1:
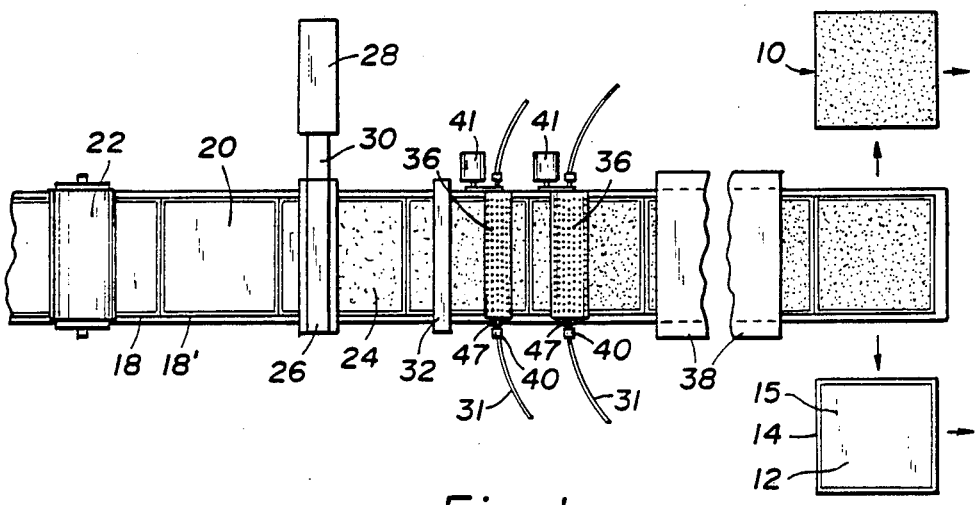
FIG. 1 is a top plan view of a portion of a ceiling tile board forming line on which a feeder supplies a viscous aqueous pulp to trays carried on a conveyor passing under a spinning roll assembly employing the teachings of this invention.

The structure of tile 10 and certain of the advantages provided therein are better illustrated and understood with reference to the novel process of manufacture illustrated in FIG. 1. Trays 18 upon which a wet pulp acoustical tile formulation is to be spread are lined with a sheet of paper or foil 20 taken from roll 22 and spread as a continuous sheet over the line of molds or trays 18. A portion of the foil sheet in each tray 18 is then covered and the tray filled with a plastic acoustical tile composition 24. Composition 24 is normally deposited in the trays as the trays, in abutting end-to-end relation, pass under feeder box 26 on a suitable moving conveyor, not shown. The feeder box is filled by the conveyor 30 from the mixer 28 in which is prepared a batch of wet aqueous pulp normally having an amylaceous binder-mineral fiber composition, but which can vary appreciably in content along the following:

thick boiling cooked starch—300 pounds
calcium sulfate hemihydrate—200 pounds
water—0–595 gallons.

In preparing the composition, the above are brought to a boil, and approximately 135 gallons are placed in a mixture with approximately 250 pounds of granulated mineral wool to obtain a wet aqueous plastic mixture.

After the composition 24 has been placed upon the trays, they pass under the reciprocating roller or smoothing bar 32 driven by a motor (not shown) and then under the texturing device of the invention 36 to impart a surface texture to the wet pulp surface. The sheet of foil is then severed between succeeding trays, as by passing a knife (not shown) between the trays, and the filled trays pass into the oven 38 where the contents are dried and cured at a temperature between 250° and 300° F. for from 12 to 18 hours. Thereafter the acoustical tile 10 is removed from the trays to produce a finished product.

Figure 2:
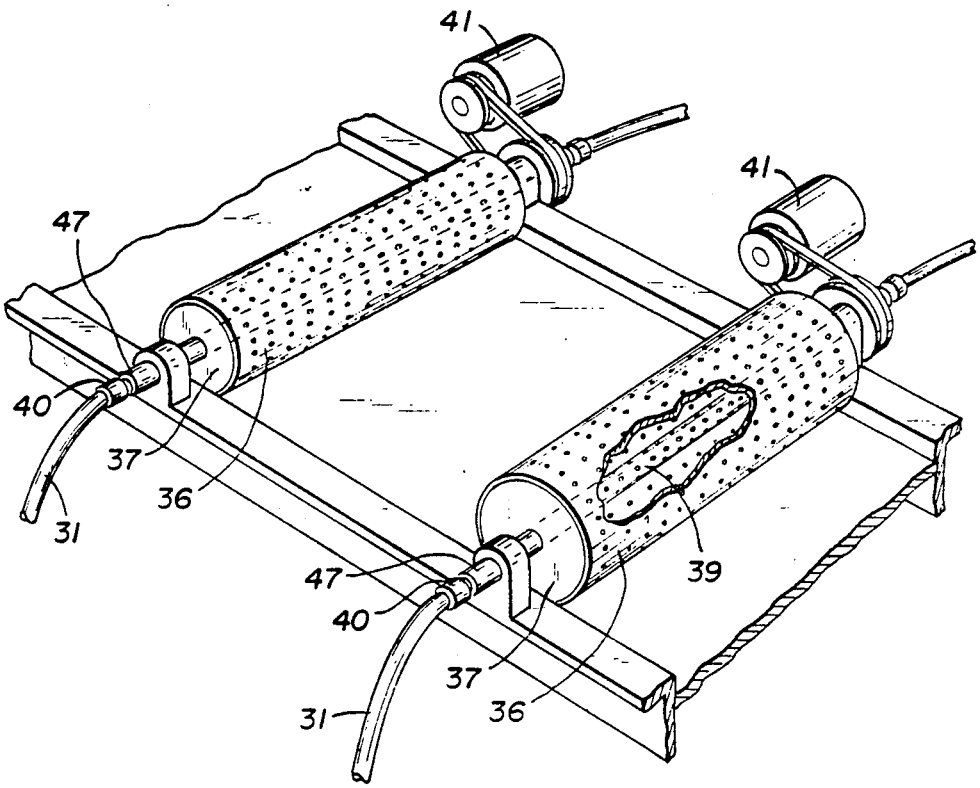
FIG. 2 is a perspective view of a portion of the spinning roll assembly partially cut away to further show teachings of this invention.

In the practice of this invention, as more particularly shown in FIG. 2, a preferred pair of hollow rolls each having a plurality of holes randomly placed therein is positioned in tandem and above a moving wet pulp ceiling tile board line as shown. The hollow cylindrical roll 36, which may conveniently be of a size of 4 to 6 inch inside diameter, is preferably provided of a length extending approximately 1–4 inches on each side beyond the edge of the trays 18 as depicted in FIG. 1. The reason for the extended roll length will soon become apparent. The surface of the roll is perforated, at specific areas approximately ¼ inch randomly spaced apart from each other with holes that have for example a 0.040 inch diameter. Each roll is equipped with an end cap 37 at each end of the roll to assist in maintaining air pressure within the roll; and preferably centered within the diameter of the roll 36 is a perforated air pressure pipeline 39 provided of ½ to 1¾ inch pipe connected to a source of air supply (not shown) via air line 31. The air line 31 has a portion thereof 40 connected to universal joint 47 for rotation and connection to roll 36, preferably with pressure pipeline 39 extending most of the length within the texturing roll 36 that is also provided with a number of random, for example 0.040 inch diameter, holes. The diameter of the texturing cylindrical roll 36 is not critical and may vary widely, a 4 inch and a 6 inch diameter roll being shown for purposes of illustration in the Figures. The number of texturing rolls 36 is also not critical; however, it has been found with experience that the use of a single roll provides a somewhat directional pattern whereas the use of two or more rolls provides a busier pattern with less directionality to the produced pattern. It is preferred that the length of the rolls 36 extend at each side approximately 1–4 inches beyond the edge of the trays 18 in order to provide a uniform texturing effect across the entire width of the tile. It has been found in practice that the approximately 2 inches of the outer edges of the roll have lessened uniformity of air pressure and tend to produce a shallower pattern than the rest of the roll. Extending the length of the perforated cylindrical roll beyond the width of trays 18 assures extending a uniform pattern across the whole surface of composition 24. It is also preferred for more uniform air pressurization to provide air pressure pipeline 39, the size and length of which is not critical. Pressure line 39 and end caps 47 are not critical, it being merely required that a means to provide uniform air pressure to the holes in the texture roll 36 be provided. The rolls 36 are preferably located about ¼ inch above the surface of the plastic tile composition 24, although the particular distance is not critical and may vary more generally between ½ inch and 1 inch. It is merely necessary that the roll 36 be suspended above the surface of the composition 24 in order to avoid picking up on the face of the roll 36 some of the wet sticky pulp composition 24. However roll distance may affect the depth of the produced texture unless air pressure is varied to compensate for different distances. Each of the rolls 36 is connected to a source of drive such as direct current motors 41. The speed of the spinning roll 36 is not critical and may vary widely to provide generally different pattern effects. Ordinarily the cylindrical rolls 36 will operate at speeds of 100–600 revolutions per minute in operation over a moving board tile line having an ordinary line speed of 10–50 feet per minute. The rolls may be spinning in a direction either with, across or against the board line direction. The faster the roll spins, the shallower will be the produced pattern as there is less time for the pressurized air to work on the surface of the composition 24 in comparison to a slower speed. The amount of air pressure to line 31 is not critical and vary over wide limits such as for example from 5 to 100 psi, generally with the lesser pressures providing a shallower pattern and the greater pressures providing a deeper pattern dependent upon distance of the surface of roll 36 to the plastic tile composition 24. Various combinations of roll speed and air pressure will produce a myriad of different pattern effects.

While FIG. 1 presents a pair of hollow rolls positioned in tandem and positioned above the moving wet pulp ceiling tile board line, each moving in a direction parallel with the board line direction, it is readily apparent that one or more texturing rolls 36 may be placed in an across-the-board-line direction or any other desired direction to give a different pattern effect.

EXAMPLES

Figure 4:
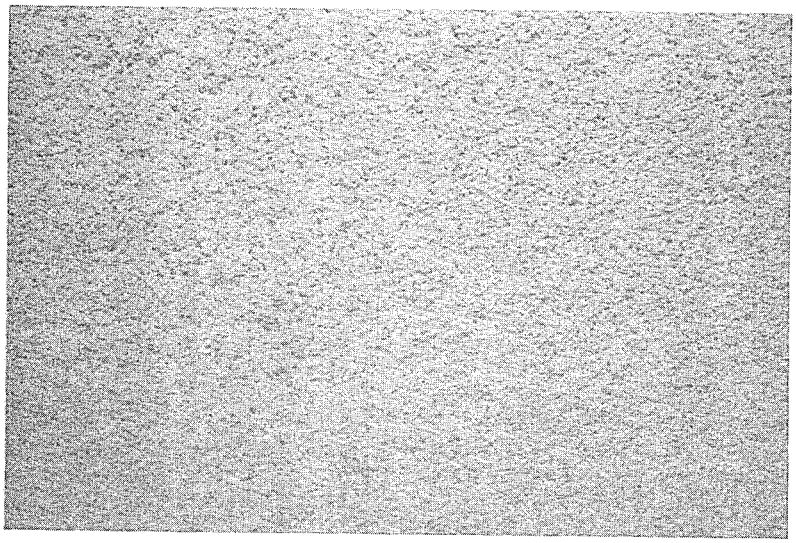
FIG. 4 represents an acoustical tile having a very coarse, bold and deep texture as made by the present invention.

In a preferred embodiment according to the present invention as depicted in FIG. 1, experimental plant trials were conducted with a 4 inch diameter hollow spinning roll positioned in tandem with a 6 inch diameter hollow spinning roll, and each positioned about ¼ inch above a moving wet pulp ceiling tile board line. The rolls 36 were perforated at specific random areas on ¼ inch spacing between holes with 0.040 inch diameter holes. The 4 inch roll was provided with approximately 200 perforations while the 6 inch roll was provided with approximately 100 perforations. Each of the rolls was driven with a ¼ horsepower direct current drive motor at selected as needed revolutions per minute. A normal plant air pressure line 31 was connected with a 1 and ¾ inch pipe line 39, also provided with a plurality of 0.040 inch perforations randomly placed therein on ¼ inch spacing. The rolls were operated, individually or in combinations, to develop an attractive series of textures. In one specific evaluation both the 4 inch and the 6 inch rolls were operated, the 4 inch roll rotating at 250 revolutions per minute while the 6 inch roll operated at 300 revolutions per minute using an air line pressure to the line 39 of 90 psi while the rolls were positioned ¼ of an inch above a ceiling tile board line being run at 44 feet per minute. This produced the coarse, naturally-looking and very bold and deeply textured fissuring shown in FIG. 4.

Figure 3:
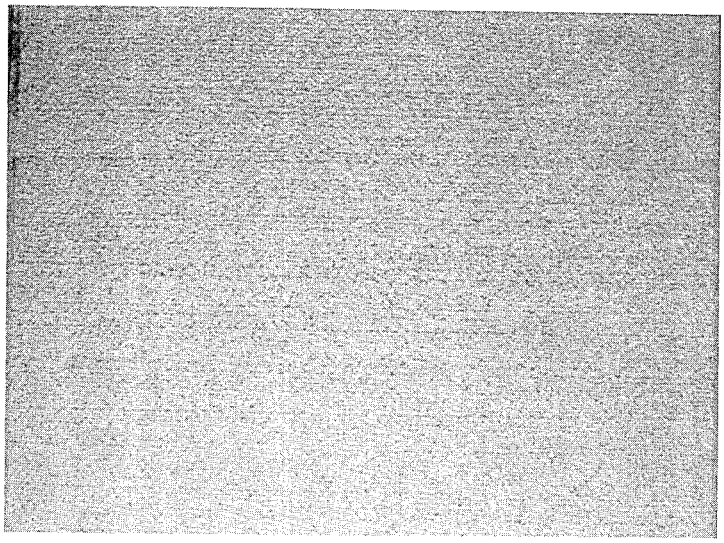
FIG. 3 represents an acoustical tile having a fine, striated texture with a limited depth made by the present invention.

In another evaluation, the approximately 4 inch diameter roll with an initial air flow fed through a ⅝ inch diameter random perforated pipeline 39 of 12–14 psi was run with the roll 36 revolving at 250 revolutions per minute while located ¼ inch above the pulp surface produced a uniform texture with only slight variation from one edge to the other edge of the sides of the tile in a fine, limited depth "frosted" pattern as depicted in FIG. 3.

In a further evaluation, ceiling board tile was texture patterned by positioning a single 4 inch roll ¼ inch above the tile line and located 5 feet down stream from the headbox. The roll was operated at a speed of 250 revolutions per minute and air pressure supplied through the orifices at 15–18 pounds per square inch to produce a uniform, directional striated "brushed" pattern.

In still another evaluation the single roll and conditions used in producing the "frosted" pattern above was repeated, but with a texture roll which did not extend beyond the line width of the tile line. At this time, the "frosted" pattern showed variations in texture depth across the tile with a shallower texture produced for about 2 inches along each side of the tile surface.

While particular embodiments of the invention have been shown, it will be understood, of course, that the invention is not limited thereto since modifications may be made by those skilled in the art in light of the foregoing teachings without departing from the spirit of this invention. For example, the location of roll 36 as rotating with, against, or across, e.g. perpendicular to, the board the board line direction is not critical and may be varied to produce different patterns. While the above depicts a board forming line utilizing trays to hold the wet composition to be textured, such is not critical and forming lines using other means to hold and/or convey the wet pulp may be employed in the practice of the present invention. The number of cylindrical rolls utilized will generally be one or two, and more may be employed without further substantial advantage.

The texture that is produced may be varied in coarseness by a variation in the size and design of the orifices, by line air pressure and by relative speeds of the texturing roll to the tile line speed. The depth of texture may be varied with a variation in the air pressure.

It will be seen in FIG. 2 that the orifices of the pipe are the outlets for the pressurized air coming into the hollow roller 36; and the orifices of the hollow roll are the outlets for the pressurized air to cut into the smooth surface of the pulp sufficiently to break up the smoothness and produce a textured surface which is natural in appearance. The size of the orifices in the roll 36 and in the preferred pipe 40 will generally range from about 0.001 inch to about ¼ inch and different hole patterns such as random placement or straight line placement at various distances from each other may be utilized to produce various different textures.

Further the air pressure line 31 may be positioned and engaged to oscillate the roll 36 back and forth across the trays 18 to impart a wavy pattern to the texture being imparted by the rotational air pressurization.

Of course ceiling tile board manufacturing lines utilizing a moving wet pulp composition of different ingredients and/or proportions than depicted in the foregoing descriptions may be employed in the practice of the present invention.

What is claimed is:

1. Apparatus for producing a three-dimensional texture pattern in the surface of ceiling tile on a moving wet pulp ceiling tile board manufacturing line comprising:

at least one hollow, rotatable, pressurized air cylinder of a first diameter, said cylinder having a plurality of spaced apart perforations penetrating through said cylinder disposed substantially throughout the surface of said cylinder;

an air pressure pipeline coaxially disposed within said air cylinder, said pipeline having a second diameter substantially less than said first diameter and further having a plurality of spaced apart perforations penetrating through said pipeline disposed substantially throughout the surface of said pipeline D';

means for supplying positively pressurized air to said pipeline;

at least one drive motor connected to said cylinder to provide rotation of the cylinder;

means for conveying a wet pulp ceiling tile composition below said air cylinder with the exposed surface of said composition spaced apart from the surface of said air cylinder;

whereby positively pressurized air passes through the perforations in said pipeline into the hollow space between the surface of the pipeline and the surface of the air cylinder, then through the perforations in the rotating cylinder and impinging on the surface of the wet pulp to produce a textured pattern on the wet pulp surface.

* * * * *